US007446725B2

(12) United States Patent
Song et al.

(10) Patent No.: US 7,446,725 B2
(45) Date of Patent: Nov. 4, 2008

(54) ANTENNA STRUCTURE ASSEMBLY

(75) Inventors: Jia-Jiu Song, Taipei County (TW); Sheng-Hsiung Yang, Hsinchu County (TW); Jr-Ren Jeng, Taipei (TW); Mu-Kun Hsueh, Kaohsiung (TW)

(73) Assignee: SmartAnt Telecom Co., Ltd., Hsinchu County (TW)

( * ) Notice: Subject to any disclaimer, the term of this patent is extended or adjusted under 35 U.S.C. 154(b) by 0 days.

(21) Appl. No.: 11/600,883

(22) Filed: Nov. 17, 2006

(65) Prior Publication Data

US 2007/0115194 A1 May 24, 2007

(30) Foreign Application Priority Data

Nov. 18, 2005 (TW) ..... 94220085 U

(51) Int. Cl.
*H01Q 1/42* (2006.01)

(52) U.S. Cl. ..... 343/789; 343/872; 343/878

(58) Field of Classification Search ..... 343/789, 343/773, 872, 878

See application file for complete search history.

(56) References Cited

U.S. PATENT DOCUMENTS

| | | | | |
|---|---|---|---|---|
| 3,441,937 | A * | 4/1969 | Clasby et al. | 343/895 |
| 5,619,217 | A * | 4/1997 | Mailandt et al. | 343/872 |
| 7,027,004 | B2 * | 4/2006 | Haunberger et al. | 343/790 |
| 2002/0135445 | A1 * | 9/2002 | Onishi | 334/85 |
| 2004/0229512 | A1 * | 11/2004 | Chen | 439/638 |
| 2006/0284779 | A1 * | 12/2006 | Parsche et al. | 343/773 |

* cited by examiner

*Primary Examiner*—Hoang V Nguyen
(74) *Attorney, Agent, or Firm*—Birch, Stewart, Kolasch & Birch, LLP

(57) ABSTRACT

An antenna structure including a ground plate, a hollow bolt, and a conductive conical dome is provided. The hollow bolt passes through the ground plate, and a signal wire is laid in the hollow bolt. An insulator is disposed between the signal wire and the hollow bolt for providing electrical isolation therebetween. The conductive conical dome is connected with one end of the signal wire. The hollow bolt and a nut are provided to fix the antenna on a wall or a ceiling. Since the signal wire is laid in the hollow bolt, the signal wire can be connected to a signal source only by connecting a signal cable to the hollow bolt.

6 Claims, 5 Drawing Sheets

ANTENNA STRUCTURE ASSEMBLY

CROSS-REFERENCE TO RELATED APPLICATIONS

This non-provisional application claims priority under 35 U.S.C. §119(a) on Patent Application No(s). 094220085 filed in Taiwan, R.O.C. on Nov. 18, 2005, the entire contents of which are hereby incorporated by reference.

BACKGROUND OF THE INVENTION

1. Field of Invention

The present invention relates to an antenna structure, and more particularly to an antenna structure that can be attached onto a ceiling, a wall, or a partition wall.

2. Related Art

Antennas are provided for emitting and receiving electric waves, and based on operating bands, antennas can be classified into ultra-long wave, long wave, medium wave, short wave, ultra-short wave, and microwave antennas from low frequency to high frequency. The antennas have been widely applied in military and civilian communication. The sizes and lengths of antennas are quite different according to different operating bandwidths and wave lengths, and antennas can also be classified into omni-directional antennas and directional antennas.

Referring to FIGS. 1 and 2, a conventional antenna structure is shown. An antenna 10 includes a ground plate 12, a signal wire 14, a conductive plate 16, and an insulating sleeve 18. The ground plate 12 is provided for electrical grounding the antenna 10, wherein the grounding plate 12 include a plate portion 122 and a hollow conical dome portion 124 raised on the plate portion 122. The conductive plate 16 and the ground plate 12 are both made of metal, and the conductive plate 16 is electrically connected to a front end the signal wire 14. The insulating sleeve 18 is slip onto the signal wire 14 and clamped between the ground plate 12 and the conductive plate 16, so as to prevent the contact of these two metal plates.

The signal wire 14 includes an extending section 142 extended from an edge of the conical dome portion 124 of the ground plate 12. Then, the extending section 142 is connected to a cable connector 144 fixed on the plate portion 122, such that the signal wire 14 is connected to a cable through the cable connector 144 and then connected to a signal source. Additionally, a seal cap 126 is mounted on the bottom surface of the plate 122 of the antenna and correspondingly under the conical dome 124. A bolt 20 passes through the central portion of the seal cap 126, so that the antenna 10 can be fixed on a ceiling or a wall with the bolt 20.

Based on the above description, the antenna 10 when being installed or used can be connected to the signal source through the cable connector 18, and the bolt 20 and the nut 22 are used together to fix the antenna onto a wall or ceiling. However, it is troublesome to install the antenna structure in two procedures, and besides that, it is also complex to manufacture and assemble the antenna structure as the antenna has a lot of parts.

SUMMARY OF THE INVENTION

Accordingly, the present invention is mainly directed to provide a simplified antenna structure, which has a reduced manufacturing cost and meanwhile can be assembled quickly and conveniently.

In order to achieve the aforementioned objects, an antenna structure of the present invention is provided, which has a design of a cable connector integrated with a bolt as a whole, and the antenna structure includes a ground plate, a hollow bolt, and a conductive conical dome. The ground plate is made of metal, and a through hole is formed on the central portion of the ground plate. The hollow bolt passes through the ground plate along the through hole, wherein a signal wire is laid in the hollow bolt and an insulator is disposed between the signal wire and the hollow bolt for providing electrical isolation therebetween. The conductive conical dome is connected with one end of the signal wire.

The antenna structure can be fixed onto a wall or ceiling by the use of the hollow bolt and a nut. Furthermore, since the signal wire is laid in the hollow bolt, the signal wire can be connected to a signal source only by connecting a signal cable to the hollow bolt.

Based on the above description, the hollow bolt of the antenna of the present invention is used to fix the antenna onto a wall or ceiling and can also be used as a cable connector, such that the antenna has a simplified structure and a low manufacturing cost and the assembly of this antenna is more convenient and quick.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

In order to further understand the technical contents and constitutive components of the present invention, the present invention will be illustrated below with reference to the drawings. However, the accompanied drawings are only for reference and illustration and are not intended to limit the present invention.

Figure 1:
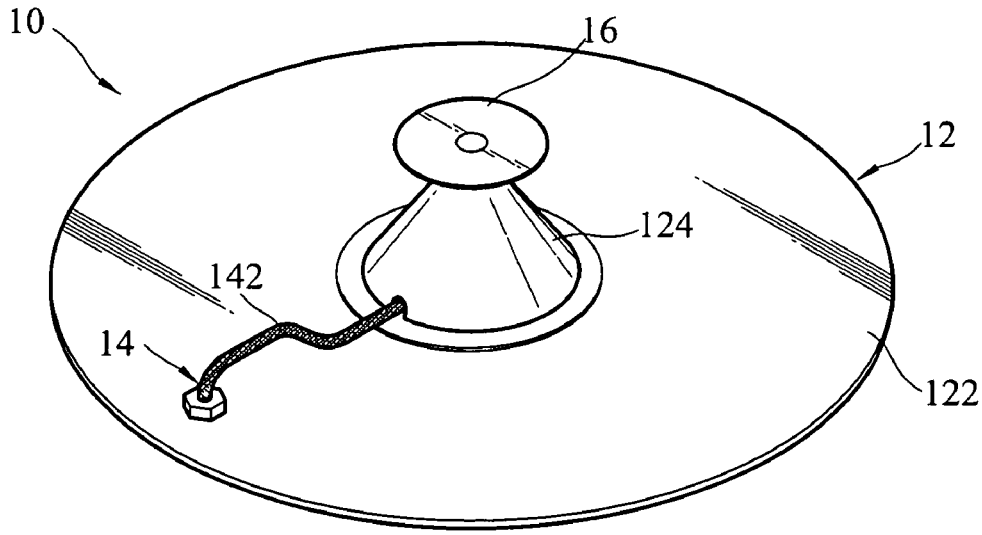
FIG.1 (PRIOR ART)
FIG. 1 is an isometric view of a conventional antenna structure.
Figure 2:
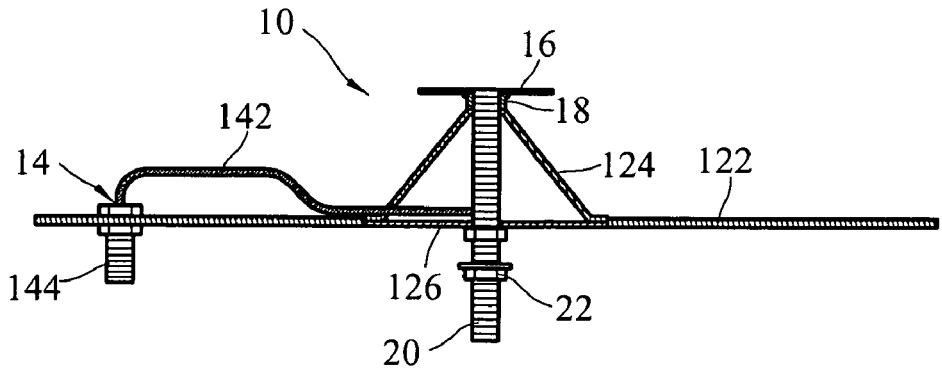
FIG.2 (PRIOR ART)
FIG. 2 is a sectional view of the structure as shown in FIG. 1.
Figure 3:
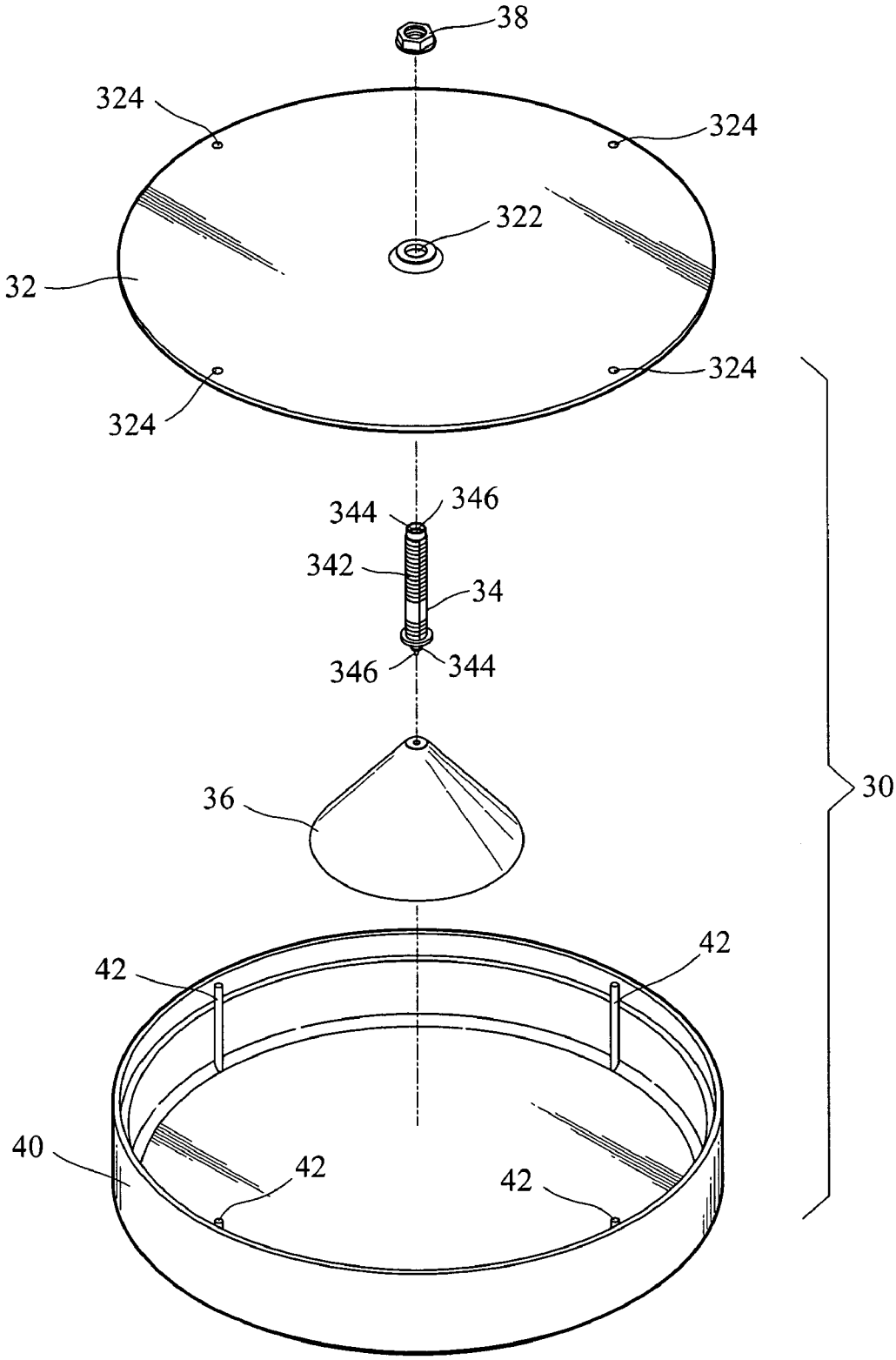
FIG. 3 is an exploded isometric view of the antenna structure of an embodiment of the present invention.
Figure 4:
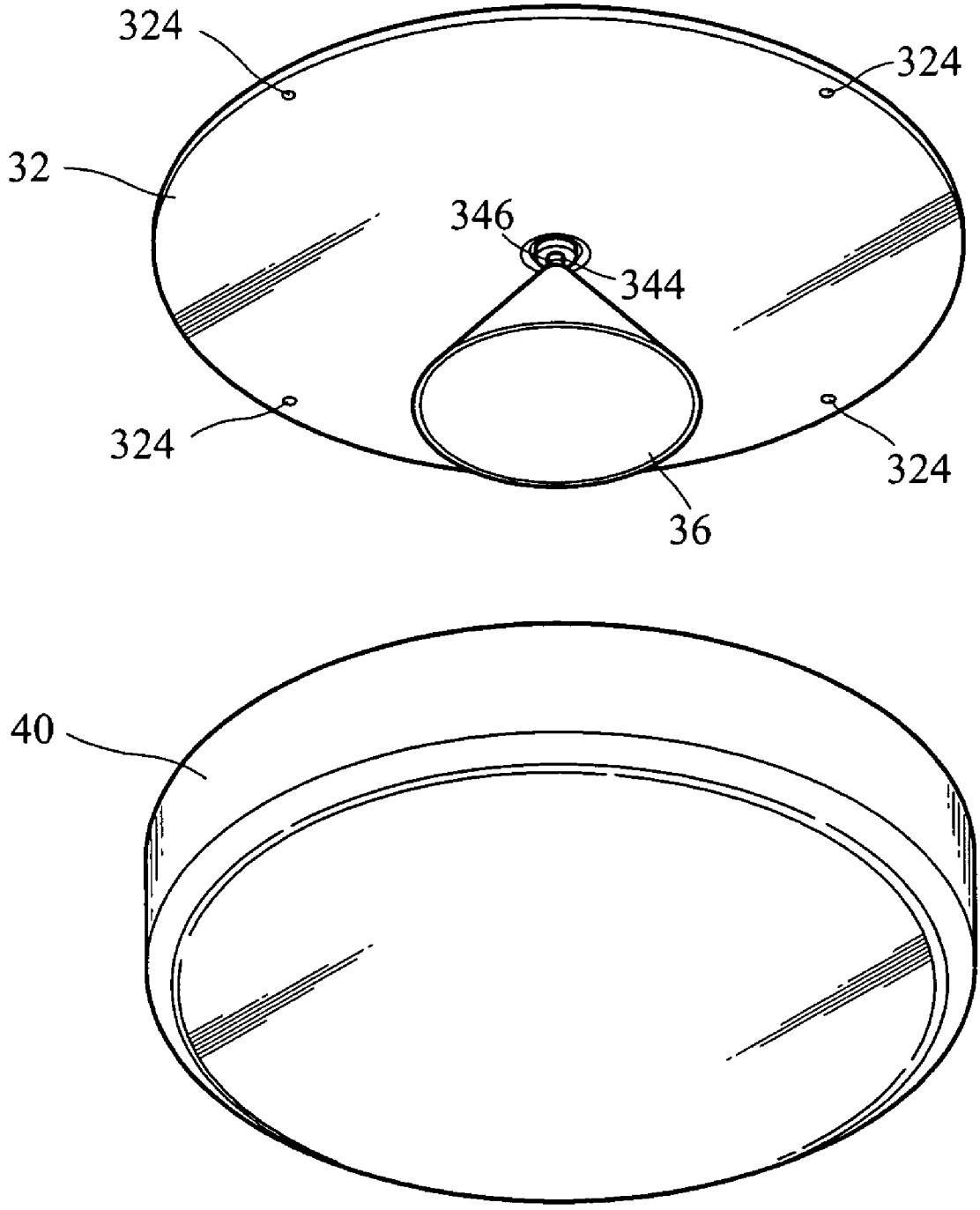
FIG. 4 is an exploded isometric view of the antenna structure of the embodiment of the present invention with some components combined together observed from another angle.

Referring to FIGS. 3 and 4, an antenna structure of an embodiment of the present invention is provided. As shown in the figures, the antenna 30 includes a ground plate 32, a hollow bolt 34, and a conductive conical dome 36.

The ground plate 32 is made of metal and has a through hole 322 formed on the central portion thereof. The ground plate 32 has a plurality of tenon holes 324 formed thereon, wherein the tenon holes 324 are formed near the outer edge of the ground plate 32 and spaced to one another with equal intervals. The hollow bolt 34 is a hollow pipe with a thread 342 formed on its outer peripheral surface, an insulator 344 is inserted into the hollow bolt 34, and a signal wire 346 is further laid in the insulator 344. In this manner, the signal wire 346 is also laid in the hollow bolt, and the insulator 344 is disposed between the signal wire 346 and the hollow bolt 34 for providing electrical isolation therebetween.

The conductive conical dome 36 is joined with one end of the hollow bolt 34 and connected with one end of the signal wire 346, and the conductive conical dome 36 is electrically isolated by the insulator 344, so that the conductive conical dome 36 is not directly contacted with the hollow bolt 34.

The hollow bolt 34 passes through ground plate 32 along the through hole 322, and the conductive conical dome 36 is joined with the hollow bolt 34, so as to fixed the conductive conical dome 36 on one side of the ground plate 32.

Figure 5:
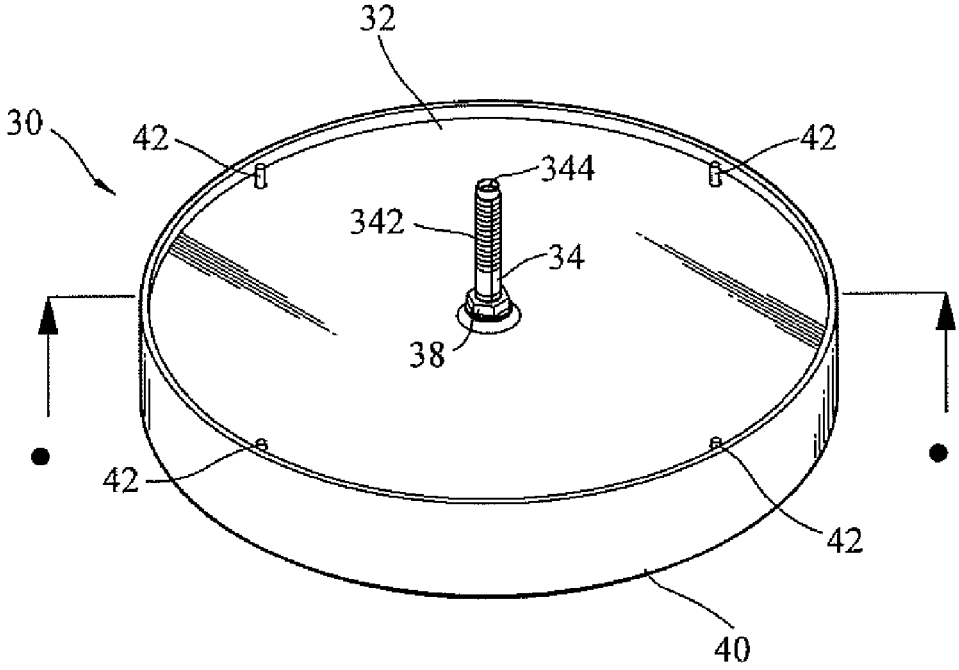
FIG. 5 is an isometric view of the antenna structure of the embodiment of the present invention after being assembled.

Further, as shown in FIG. 5, a nut 38 is tighten onto the hollow bolt 34 from another side of the ground plate 32 opposite to the conductive conical dome 36, such that the conductive conical dome 36, the ground plate 32, and the hollow bolt 34 are combined as a whole.

Figure 6:
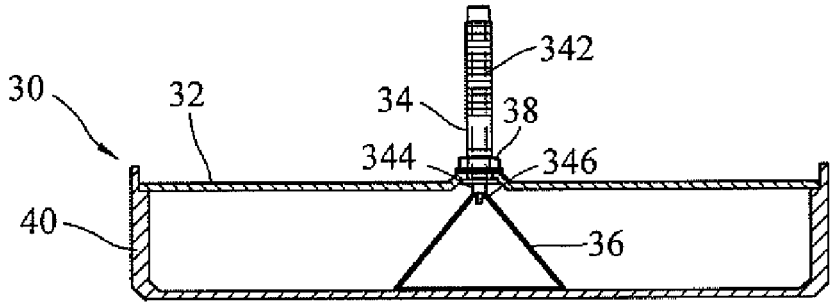
FIG. 6 is a sectional view of the antenna structure along Line A-A in FIG. 5.

Referring to FIGS. 5 and 6, after the aforementioned components of the antenna are combined together, a cover 40 is mounted onto the grounding plate 32. The cover 40 has a plurality of tenon poles 42, and the tenon poles 42 are inserted into the corresponding tenon holes 324 of the ground plate 32 for mounting the cover 40 onto the ground plate 32. A space is defined between the cover 40 and the ground plate 32. Enclosed by the cover 40 and the ground plate 32, the conductive conical dome 36 is hidden in the space defined between the cover 40 and the grounding plate 32.

Figure 7:
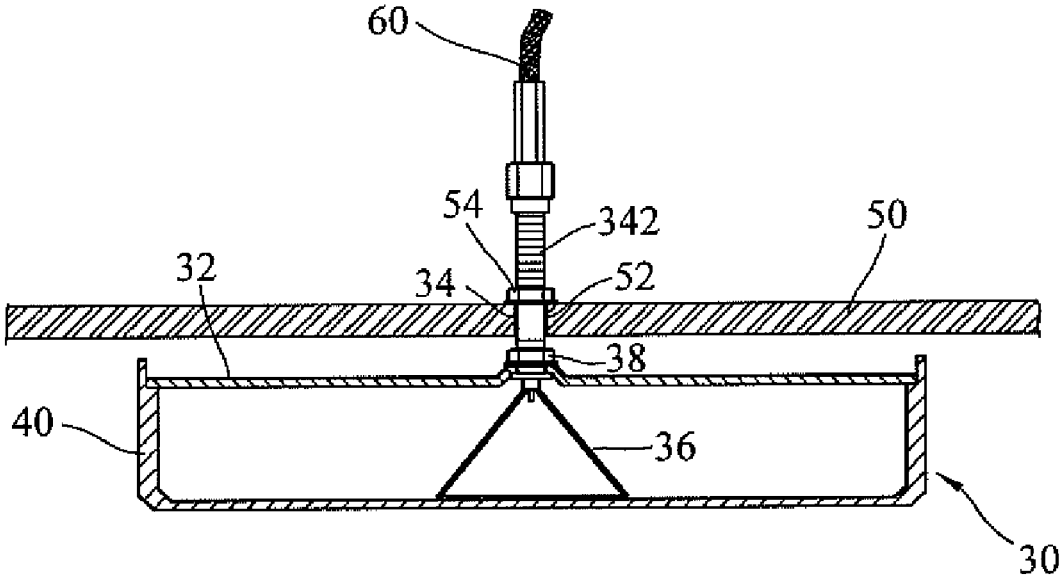
FIG. 7 is a schematic view of the application of the antenna structure of the embodiment of the present invention being fixed onto a ceiling.

Referring to FIG. 7, in view of the above, the antenna 30 of the present invention has a design that the signal wire 346 is laid in the hollow bolt 34. The antenna 30 can be combined with and attached onto the surface of a wall or ceiling 50 by using the hollow bolt 34 passing through a positioning hole 52 in the wall or ceiling 50 and locking a nut 54 onto another end of the hollow bolt 34 which has already passed through the wall or ceiling 50. After the antenna 30 is positioned, since the signal wire 346 is laid in the hollow bolt 34, the signal wire 346 can be connected to a signal source only by connecting a cable 60 to the upper edge of the hollow bolt 34.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An antenna structure assembly, attachable to a wall, comprising:

a ground plate, which is made of metal;

a hollow bolt, one end of the hollow bolt passing through and fixed with the ground plate, the other end of the hollow bolt attachable to the wall a signal wire, laid in the hollow bolt;

an insulator, disposed between the signal wire and the hollow bolt to electrically isolate the signal wire from the hollow bolt; and a conductive conical dome, joined with one end of the hollow bolt and electrically connected with one end of the signal wire.

2. The antenna structure assembly as claimed in claim 1, wherein a through hole is formed on the ground plate for the hollow bolt passing through and being fixed with the ground plate.

3. The antenna structure assembly as claimed in claim 1, wherein a nut is tightened onto the hollow bolt from one side of the ground plate to fix the hollow bolt to the ground plate.

4. The antenna structure assembly as claimed in claim 1, wherein the hollow bolt is a hollow pipe with a thread formed on its outer peripheral surface.

5. The antenna structure assembly as claimed in claim 1, wherein a cover is mounted onto the ground plate, and the conductive conical dome is hidden in a space defined between the cover and the ground plate.

6. The antenna structure assembly as claimed in claim 5, wherein the ground plate has a plurality of tenon holes and the cover has a plurality of tenon poles to be inserted into the tenon holes for mounting the cover onto the ground plate.

* * * * *